United States Patent [19]

Bieber et al.

[11] Patent Number: 4,976,340

[45] Date of Patent: Dec. 11, 1990

[54] FILE FOLDER FOR ATTACHE CASE

[75] Inventors: David Bieber, East Greenwich; Lester E. Carpenter, Middletown, both of R.I.

[73] Assignee: American Tourister, Inc., Warren, R.I.

[21] Appl. No.: 475,751

[22] Filed: Feb. 6, 1990

[51] Int. Cl.[5] ..... A45C 3/02; A45C 13/00

[52] U.S. Cl. ..... 190/109; 190/900; 150/900

[58] Field of Search ..... 190/109-111, 190/900, 108, 102, 100, 36; 150/900, 112; 383/43; 220/20, 23

[56] References Cited

U.S. PATENT DOCUMENTS

| | | | |
|---|---|---|---|
| 2,101,459 | 12/1937 | Satz | 190/900 X |
| 2,564,570 | 8/1951 | Hatfield | 150/900 X |
| 2,595,089 | 4/1952 | Lifton | 190/108 |
| 2,782,890 | 2/1957 | Powell et al. | 190/108 |
| 2,804,114 | 8/1957 | Nash | 150/900 X |
| 3,104,289 | 9/1963 | Segel | 190/102 X |
| 3,123,190 | 3/1964 | Lifton | 190/108 |
| 3,263,779 | 8/1966 | Bialer | 190/110 |
| 3,306,405 | 2/1967 | Rosenblum | 190/110 |
| 4,265,286 | 5/1981 | Rapoport | 190/108 |
| 4,433,761 | 2/1984 | Winter et al. | 190/109 |

FOREIGN PATENT DOCUMENTS

| | | | |
|---|---|---|---|
| 702285 | 4/1931 | France | 220/20 |
| 16944 | 7/1897 | United Kingdom | 220/20 |

*Primary Examiner*—Sue A. Weaver

*Attorney, Agent, or Firm*—Wood, Herron & Evans

[57] ABSTRACT

An attache case has a generally rectangular container and a lid hinged to the container. An accordion type file folder is attached to the lid. A U-shaped spring attached to the lid adjacent its hinge to the container normally urges the file folder to a closed condition.

7 Claims, 1 Drawing Sheet

FILE FOLDER FOR ATTACHE CASE

BACKGROUND OF THE INVENTION

This invention relates to a file folder for an attache case.

Attache cases have a generally rectangular container and a lid hinged to the container. It has been well known to provide a file folder mounted in the attache case lid. The file folder consists of an outer wall and one or more dividers interconnected by webs or gussets along side edges, in accordion fashion, to create multiple expandible pockets.

In use, the attache case is normally set flat on a surface and the lid is opened and raised to a vertical attitude. In that attitude, the pockets can hang free, overhanging to some extent the container. When the pockets are not in use and they are hanging free, they are in the way of the convenient and orderly removal and replacement of files in the main container. To eliminate the overhanging problem, it has been conventional practice to provide straps at the sides of the lid, the straps having fasteners at their free ends cooperating with the outer wall of the file folder to hold the file folder snugly within the confines of the lid.

The straps do flap about. The straps require manipulation to unfasten and fasten them when opening the pockets and returning the pockets of the file folder snugly against the lid, respectively. Even with these disadvantages, the straps have been used to retain the file folder within the confines of the lid for at least fifty years.

SUMMARY OF THE INVENTION

It has been an objective of the present invention to provide a multiple pocket file folder with an automatic closing mechanism.

This objective of the invention has been attained by providing a spring closure mounted on the lid. More specifically, a U-shaped spring wire is connected at its free ends to the rear wall of the lid adjacent to the hinge connecting that wall to the attache case container. The spring is coiled at its ends adjacent the points of connection to the lid rear wall to create a biasing force toward the main wall of the lid. The free portion of the U-shaped wire spring is secured to an outer divider or outer wall of the file folder to urge the file folder to a closed condition.

This spring-biased file folder structure permits the pockets to be opened simply by pulling against the outer wall of the file folder to pivot it outwardly against the force of the spring. When the pockets are emptied or partially emptied, the spring will urge the file folder to lie snugly within the confines of the lid. There are no straps to dangle or to be manipulated in opening and closing the file folder.

BRIEF DESCRIPTION OF THE DRAWINGS

The several features of the invention will become more readily apparent from the following detailed description taken in conjunction with the accompanying drawings in which.

DETAILED DESCRIPTION OF THE INVENTION

Figure 1:
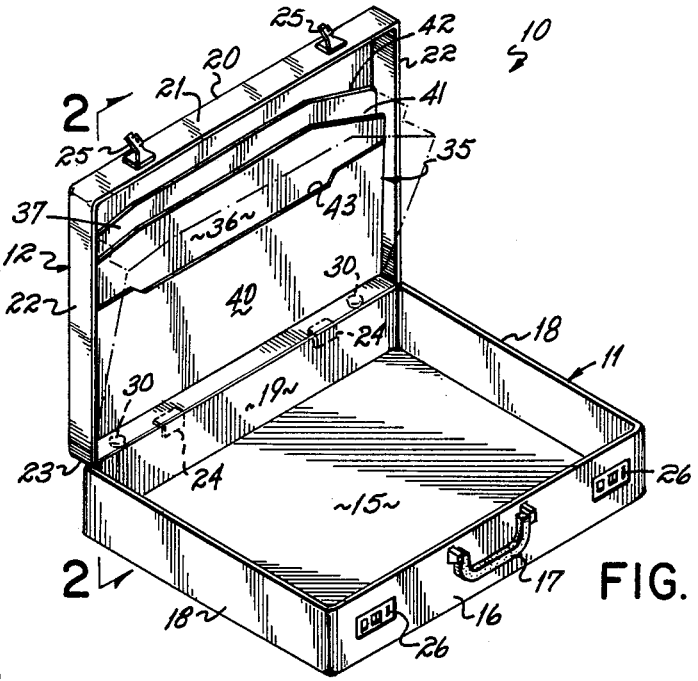
FIG. 1 is a perspective view of an attache case with its lid open.

Referring to FIG. 1, an attache case is shown at 10 and has a rectangular container 11 to which a lid 12 is hinged. The rectangular container has a bottom wall 15, a front wall 16 to which a handle 17 is attached, two side walls 18 and a rear wall 19. Similarly, the lid has a top wall 20, a front wall 21, side walls 22 and a rear wall 23. The rear wall 23 is connected by hinges 24 to the rear wall 19 of the container 11. Cooperating fastener elements 25 and 26 are mounted on the front walls of the lid 12 and container 11, respectively, to close and to lock the attache case. Bumper feet 30 are mounted on the rear walls 19 and 23 of the container and lid, respectively, to support the attache case off the ground when it has been set down, thereby protecting the rear surfaces of the case.

Figure 2:
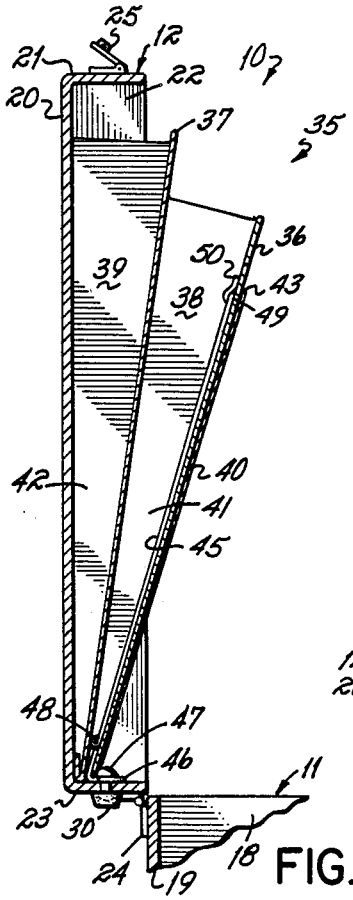
FIG. 2 is a cross-sectional view taken along lines 2—2 of FIG. 1 showing the file folder in an open position.

A file folder 35 is mounted in the lid. The file folder 35 can have one or multiple pockets. As shown in FIG. 2, in the illustrated form of the invention, the file folder 35 has a first divider 36 and a second divider 37. The first divider is connected to the second divider by side webs or gussets 38. The second divider 37 is connected to the top wall 20 of the lid by webs or gussets 39, thus creating two deep pockets 41 and 42. A fabric or leather sheet 40 overlies a portion of the first divider 36 to create a shallow pocket 43.

Figure 3:
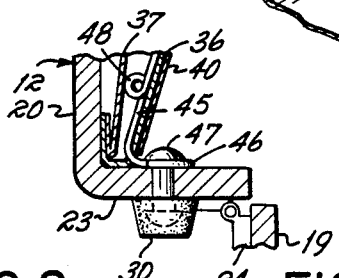
FIG. 3 is an enlarged view of the rivet and bumper feet attachment.
Figure 4:
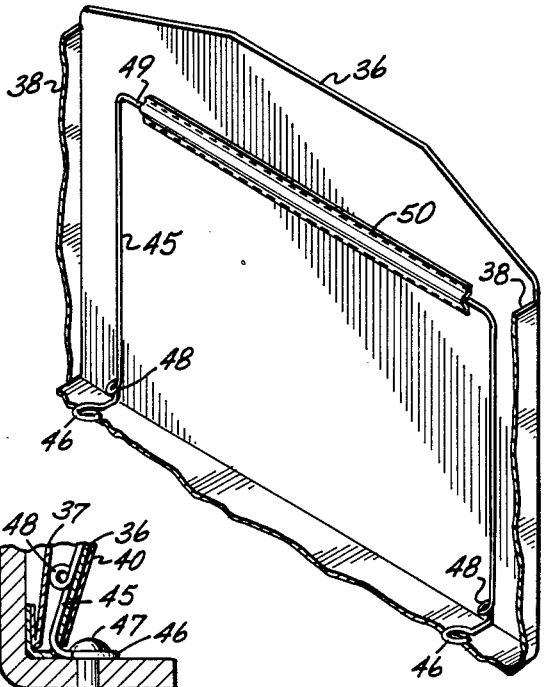
FIG. 4 is a rear perspective view of a divider to which the spring is mounted.

Referring to FIG. 4, it can be seen that an inverted U-shaped wire spring 45 is attached to the rear surface of the first divider 36 that forms an outer wall for the file folder 35. The wire 45 is on the side of the divider facing the second divider so that it is concealed. The ends of the wire are formed with loops 46, the loops being riveted to the lid rear wall 23 by the same rivets 47 that attach the bumper feet 30, as shown in FIG. 3. Immediately adjacent the loops 46 are coils 48 formed in the spring steel wire. The coils 48 serve as coil springs which urge the divider 36 against the top wall 20. The wire has a bight portion 49 that is connected to the divider 36 by a vinyl plastic extrusion 50 (FIG. 4) which is stitched over the wire 45 to the divider panel. The wire 45 is approximately 12 gauge (0.105" diameter) in the preferred form of the invention.

In the operation of the invention, the wire 45 normally urges the file folder 35 snugly against the top wall 20 of the lid 12 within the confines of the front 21, rear 23 and side walls 22 of the lid 12. When papers are to be put in the file folder 35, the user merely pulls the outer divider 36 away from the top wall 20, thereby opening outer and inner pockets 42, 43. When the outer divider 36 is released, the file folder 35 closes automatically through the urging of the wire spring 45, thereby returning the file folder to the confines of the lid 12 without the need of straps or other fasteners that require special manipulation.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. An attache case comprising:

a generally rectangular container, a lid having a top wall and depending front, rear and side walls, said rear wall being hinged to said rectangular container, a file folder having at least one wall having a lower edge connected to said lid and an upper edge that is swingable away from said lid, a flexible, generally triangular-shaped web connecting said file folder wall on each side thereof to said top wall to form at least one pocket that is expandible as said file folder wall swings away from said top wall, and a spring wire fixed directly to said rear wall and connected directly to said file folder wall to urge said file folder wall toward said top wall to close said pocket.

2. An attache case as in claim 1 in which said file folder comprises:

an outer wall, at least two dividers located between said outer wall and said top wall, webs interconnecting said dividers and walls, said spring being mounted on said outermost divider.

3. An attache case comprising:

a generally rectangular container, a lid having a top wall and depending front, rear and side walls, said rear wall being hinged to said rectangular container, a file folder having a rear divider having side edges connected to said top wall of said lid by flexible webs, and a front divider having side edges connected to said rear divider by flexible webs, a U-shaped wire spring having ends fixed to said lid rear wall, said spring having a bight portion fixed to said front divider on the surface facing said rear divider.

4. An attache case as in claim 3 further comprising:

two spaced bumpers on said lid rear wall, rivets joining said bumpers and spring ends to said rear wall.

5. An attache case comprising:

a generally rectangular container, a lid having a top wall and depending front, rear and side walls, said rear wall being hinged to said rectangular container, a file folder having at least one wall, a flexible web connecting said file folder wall to said top wall to form at least one pocket that is expandible as said file folder wall swings away from said top wall, and a spring wire fixed to said rear wall and connected to said file folder wall to urge said file folder wall toward said top wall to close said pocket, said spring wire being of a U-shape having ends riveted to said rear wall, the portion of said U-shape intermediate said ends being fastened to said file folder wall.

6. An attache case as in claim 5 further comprising:

a plastic extrusion overlying the upper portion of said spring wire, said extrusion being stitched to said file folder wall.

7. An attache case as in claim 5 further comprising:

said wire having loops adjacent said ends to create coiled springs, urging said wire toward said top wall.

* * * * *